US009551052B2

(12) United States Patent
Morimoto et al.

(10) Patent No.: US 9,551,052 B2
(45) Date of Patent: Jan. 24, 2017

(54) RARE EARTH SINTERED MAGNET AND METHOD FOR PRODUCTION THEREOF

(75) Inventors: Hideyuki Morimoto, Osaka (JP); Tomoori Odaka, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 1252 days.

(21) Appl. No.: 11/575,928

(22) PCT Filed: Jul. 14, 2006

(86) PCT No.: PCT/JP2006/314076

§ 371 (c)(1),
(2), (4) Date: Mar. 23, 2007

(87) PCT Pub. No.: WO2007/010860

PCT Pub. Date: Jan. 25, 2007

(65) Prior Publication Data

US 2009/0053094 A1 Feb. 26, 2009

(30) Foreign Application Priority Data

Jul. 15, 2005 (JP) ..... 2005-207645
Aug. 11, 2005 (JP) ..... 2005-233110
(Continued)

(51) Int. Cl.
*C22C 38/00* (2006.01)
*C22C 33/02* (2006.01)
(Continued)

(52) U.S. Cl.
CPC ..... *C22C 38/005* (2013.01); *C22C 33/0278* (2013.01); *C22C 38/002* (2013.01);
(Continued)

(58) Field of Classification Search
CPC ..... C22C 33/0278; C22C 38/005; H01F 41/0273; H01F 41/0577; B22F 3/10
(Continued)

(56) References Cited

U.S. PATENT DOCUMENTS 4,770,723 A 9/1988 Sagawa et al.
4,773,950 A 9/1988 Fujimura et al.
(Continued)

FOREIGN PATENT DOCUMENTS

JP 59-89401 A 5/1984
JP 59-132104 A 7/1984
(Continued)

OTHER PUBLICATIONS

English translation of JP 04-293206.*
(Continued)

*Primary Examiner* — Rebecca Lee
(74) *Attorney, Agent, or Firm* — Keating & Bennett, LLP

(57) ABSTRACT

A rare-earth sintered magnet includes 12.0 at % to 15.0 at % of rare-earth element(s), which is at least one element selected from the group consisting of Nd, Pr, Gd, Tb, Dy and Ho and at least 50% of which is Nd and/or Pr; 5.5 at % to 8.5 at % of boron (B); a predetermined percentage of additive metal A; and iron (Fe) and inevitably contained impurities as the balance. The predetermined percentage of additive metal A includes at least one of 0.005 at % to 0.30 at % of silver (Ag), 0.005 at % to 0.40 at % of nickel (Ni), and 0.005 at % to 0.20 at % of gold (Au).

3 Claims, 9 Drawing Sheets

(30) Foreign Application Priority Data

| | | |
|---|---|---|
| Nov. 8, 2005 | (JP) | 2005-324058 |
| Dec. 2, 2005 | (JP) | 2005-349280 |
| Feb. 16, 2006 | (JP) | 2006-039274 |

(51) Int. Cl.

| | |
|---|---|
| ***C22C 38/06*** | (2006.01) |
| ***C22C 38/08*** | (2006.01) |
| ***H01F 1/057*** | (2006.01) |
| ***H01F 41/02*** | (2006.01) |

(52) U.S. Cl.

CPC ..... *C22C 38/06* (2013.01); *C22C 38/08* (2013.01); *H01F 1/0577* (2013.01); *H01F 41/0273* (2013.01); *B22F 2998/10* (2013.01)

(58) Field of Classification Search

USPC ..... 420/82; 419/33, 65

See application file for complete search history.

(56) References Cited

U.S. PATENT DOCUMENTS

| | | | |
|---|---|---|---|
| 4,792,368 | A | 12/1988 | Sagawa et al. |
| 4,840,684 | A | 6/1989 | Fujimura et al. |
| 4,995,905 | A | 2/1991 | Sagawa |
| 5,250,206 | A | 10/1993 | Nakayama et al. |
| 5,383,978 | A | 1/1995 | Yamamoto et al. |
| 6,045,751 | A | 4/2000 | Buschow et al. |
| 6,287,391 | B1 | 9/2001 | Kanekiyo et al. |
| 2001/0023716 | A1 | 9/2001 | Hirosawa et al. |
| 2006/0207689 | A1 | 9/2006 | Iwasaki et al. |

FOREIGN PATENT DOCUMENTS

| | | | | |
|---|---|---|---|---|
| JP | 59-204211 | A | 11/1984 | |
| JP | 60-32306 | A | 2/1985 | |
| JP | 60-138056 | A | 7/1985 | |
| JP | 60-184661 | A | 9/1985 | |
| JP | 61-034242 | B2 | 8/1986 | |
| JP | 61-221353 | A | 10/1986 | |
| JP | 63-241141 | A | 10/1988 | |
| JP | 63-241142 | A | 10/1988 | |
| JP | 1-220803 | A | 9/1989 | |
| JP | 04-133406 | A | 5/1992 | |
| JP | 04-217302 | A | 8/1992 | |
| JP | 04-293206 | A | 10/1992 | |
| JP | 04-343204 | A | 11/1992 | |
| JP | 05-062814 | A | 3/1993 | |
| JP | 05-074618 | A | 3/1993 | |
| JP | 05-205927 | A | 8/1993 | |
| JP | 05-234733 | A | 9/1993 | |
| JP | 06-084550 | B2 | 10/1994 | |
| JP | 07-272929 | A | 10/1995 | |
| JP | 09-270310 | A | 10/1997 | |
| JP | 2787580 | B | 8/1998 | |
| JP | 2003-017308 | A | 1/2003 | |
| JP | 2004-277795 | A | 10/2004 | |
| JP | 2005-294557 | A | 10/2005 | |
| WO | WO 8908318 | A1 * | 9/1989 | ..... H01F 1/08 |

OTHER PUBLICATIONS

Machine translation of JP 07-272929, 1995.*

English translation of official communication issued in counterpart International Application No. PCT/JP2006/314076, mailed on Jan. 24, 2008.

Official Communication for PCT Application No. PCT/JP2006/314076; mailed on Aug. 8, 2006.

Official Communication issued in corresponding Chinese Patent Application No. 200680000948.0, mailed on Apr. 13, 2010.

Official Communication issued in corresponding Japanese Patent Application No. 2005-207645, mailed on Apr. 27, 2010.

Official Communication issued in corresponding Japanese Patent Application No. 2011-005600, mailed on Sep. 4, 2012.

* cited by examiner

RARE EARTH SINTERED MAGNET AND METHOD FOR PRODUCTION THEREOF

BACKGROUND OF THE INVENTION

1. Field of the Invention

The present invention relates to a rare-earth sintered magnet and a method for producing the magnet.

2. Description of the Related Art

A rare-earth-iron-boron based rare-earth sintered magnet, which is a typical high-performance permanent magnet, has a structure including an $R_2Fe_{14}B$-type crystalline phase (main phase), which is a tetragonal compound, and grain boundary phases, and achieves excellent magnet performance. In $R_2Fe_{14}B$, R is at least one element selected from the group consisting of the rare-earth elements and yttrium and includes Nd and/or Pr as its main ingredients, Fe is iron, B is boron, and these elements may be partially replaced with other elements. The grain boundary phases include an R-rich phase including a rare-earth element R at a relatively high concentration and a B-rich phase including boron at a relatively high concentration.

The rare-earth-iron-boron based rare-earth sintered magnet will be referred to herein as an "R-T-B based sintered magnet", where T is a transition metal element consisting essentially of iron. In the R-T-B based sintered magnet, an $R_2T_{14}B$ phase (main phase) is a ferromagnetic phase contributing to magnetization and the R-rich phase on the grain boundary is a low-melting nonmagnetic phase.

An R-T-B based sintered magnet is produced by compressing and compacting a fine powder (with a mean particle size of several μm) of a (mother) alloy to make an R-T-B based sintered magnet using a press machine and then sintering the resultant green compact. The sintered compact is then subjected to an aging treatment if necessary. The mother alloy to make such an R-T-B based sintered magnet is preferably made by an ingot process using die casting or by a strip casting process in which a molten alloy is quenched using a chill roller.

To produce an R-T-B based sintered magnet with high coercivity, it is proposed that Nd or Pr, which is used extensively as a rare-earth element R, be partially replaced with a heavy rare-earth element such as Dy, Ho and/or Tb (see Japanese Patent Application Laid-Open Publication No. 60-32306 (Patent Document No. 1), for example). Since Dy, Tb and Ho are rare-earth elements with a highly anisotropic magnetic field, the coercivity can be increased effectively by replacing Nd with at least one of those elements at the site of the rare-earth element R in the main phase.

On the other hand, ever since the R-T-B based sintered magnet was developed, a very small amount of Al or Cu has been added to improve the coercivity (see Japanese Patent Application Laid-Open Publication No. 5-234733 (Patent Document No. 2), for example). More specifically, when the R-T-B based sintered magnet was developed for the first time, Al and Cu were regarded as impurities that were inevitably contained in the material alloy. However, it was discovered afterward that Al and Cu are actually almost essential elements that should be added to increase the coercivity of the R-T-B based sintered magnet. It is also known that if Al and Cu were eliminated intentionally, the coercivity of the R-T-B based sintered magnet would be too low to actually use it in various applications.

Other magnets are disclosed in Japanese Patent Application Laid-Open Publication No. 4-217302 (Patent Document No. 3) and Japanese Patent Application Laid-Open Publication No. 60-138056 (Patent Document No. 4).

Also, Japanese Patent Application Laid-Open Publication No. 2004-277795 (Patent Document No. 5) and Japanese Patent No. 2787580 (Patent Document No. 6) disclose that vanadium (V) is preferably added to increase the coercivity sufficiently.

Furthermore, Japanese Patent Application Laid-Open Publication No. 59-89401 (Patent Document No. 7), Japanese Patent Application Laid-Open Publication No. 59-132104 (Patent Document No. 8), Japanese Patent Application Laid-Open Publication No. 1-220803 (Patent Document No. 9), Japanese Patent Application Laid-Open Publication No. 5-205927 (Patent Document No. 10), and Japanese Patent Application Laid-Open Publication No. 2003-17308 (Patent Document No. 11) disclose rare-earth sintered magnets to which various metal elements are added.

The greater the amount of Dy, Tb or Ho added, the higher the coercivity can be. However, Dy, Tb and Ho are very rare elements. That is why if demands for highly refractory magnets to be used in motors for electric cars continue to grow as electric cars become increasingly popular in the near future, the Dy resources will soon be almost exhausted. In that case, there will be serious concerns about a potential upsurge of material costs. For that reason, it is an urgent task to develop some technique of reducing the amount of Dy to be used in high-coercivity magnets. Meanwhile, the additives Al, Cu and V increase the coercivity but decrease the remanence $B_r$, which is also a problem.

SUMMARY OF THE INVENTION

In order to overcome the problems described above, a primary object of the present invention is to provide a rare-earth sintered magnet that has as high coercivity as, and higher remanence than, a magnet to which Al or Cu is added.

A rare-earth sintered magnet according to the present invention includes: 12.0 at % to 15.0 at % of rare-earth element(s), which is at least one element selected from the group consisting of Nd, Pr, Gd, Tb, Dy and Ho and at least 50% of which is Nd and/or Pr; 5.5 at % to 8.5 at % of boron (B); a predetermined percentage of additive metal A; and iron (Fe) and inevitably contained impurities as the balance. The predetermined percentage of additive metal A includes at least one of 0.005 at % to 0.30 at % of silver (Ag), 0.005 at % to 0.40 at % of nickel (Ni), and 0.005 at % to 0.20 at % of gold (Au).

In one preferred embodiment, the magnet includes 0.005 at % to 0.20 at % of Ag.

In another preferred embodiment, the magnet includes 0.005 at % to 0.20 at % of Ni.

In still another preferred embodiment, the magnet includes 0.005 at % to 0.10 at % of Au.

In yet another preferred embodiment, the inevitably contained impurities include Al, of which the content is 0.4 at % or less.

In yet another preferred embodiment, the magnet further includes 0.05 at % to 1.0 at % of element M, which is at least one element selected from the group consisting of Ti, V, Cr, Zr, Nb, Mo, Hf, Ta and W.

A method for producing a rare-earth sintered magnet according to the present invention includes the steps of: providing an alloy, which includes: 12.0 at % to 15.0 at % of rare-earth element(s), which is at least one element selected from the group consisting of Nd, Pr, Gd, Tb, Dy and Ho and at least 50% of which is Nd and/or Pr; 5.5 at % to 8.5 at % of boron (B); a predetermined percentage of additive metal A; and iron (Fe) and inevitably contained impurities as the balance and in which the predetermined percentage of additive metal A includes at least one of 0.005 at % to 0.30 at % of silver (Ag), 0.005 at % to 0.40 at % of nickel (Ni), and 0.005 at % to 0.20 at % of gold (Au); pulverizing the alloy to make a powder; and sintering the powder.

In one preferred embodiment, the alloy further includes 0.05 at % to 1.0 at % of element M, which is at least one element selected from the group consisting of Ti, V, Cr, Zr, Nb, Mo, Hf, Ta and W.

In another preferred embodiment, the inevitably contained impurities include Al, of which the content is 0.4 at % or less.

Another method for producing a rare-earth sintered magnet according to the present invention includes the steps of: providing an alloy, which includes: 12.0 at % to 15.0 at % of rare-earth element(s), which is at least one element selected from the group consisting of Nd, Pr, Gd, Tb, Dy and Ho and at least 50% of which is Nd and/or Pr; 5.5 at % to 8.5 at % of boron (B); and iron (Fe) and inevitably contained impurities as the balance; pulverizing the alloy to make a powder; adding at least one of 0.005 at % to 0.30 at % of silver (Ag), 0.005 at % to 0.40 at % of nickel (Ni), and 0.005 at % to 0.20 at % of gold (Au) to the powder, thereby making a powder including a very small amount of additive element; and sintering the powder including the very small amount of additive element.

In one preferred embodiment, 0.05 at % to 1.0 at % of element M, which is at least one element selected from the group consisting of Ti, V, Cr, Zr, Nb, Mo, Hf, Ta and W, has been further added to the powder including the very small amount of additive element.

In another preferred embodiment, the inevitably contained impurities include Al, of which the content is 0.4 at % or less.

Still another method for producing a rare-earth sintered magnet according to the present invention includes the steps of: (A) providing an alloy powder to make a rare-earth magnet, the powder including: 12.0 at % to 15.0 at % of rare-earth element(s), which is at least one element selected from the group consisting of Nd, Pr, Gd, Tb, Dy and Ho and at least 50% of which is Nd and/or Pr; 5.5 at % to 8.5 at % of boron (B); and iron (Fe) and inevitably contained impurities as the balance, a lubricant being added to the powder, and (B) making a compact of the alloy powder and sintering the compact. The lubricant includes an aliphatic silver carboxylate or an aromatic silver carboxylate.

In one preferred embodiment, the amount of the aliphatic silver carboxylate or the aromatic silver carboxylate to add is adjusted such that the rare-earth sintered magnet includes 0.005 at % to 0.20 at % of Ag.

In another preferred embodiment, the step (A) of providing the alloy powder includes the steps of: (a1) providing an alloy to make a rare-earth magnet, the alloy including 12.0 at % to 15.0 at % of rare-earth element(s), which is at least one element selected from the group consisting of Nd, Pr, Gd, Tb, Dy and Ho and at least 50% of which is Nd and/or Pr; 5.5 at % to 8.5 at % of boron (B); and iron (Fe) and inevitably contained impurities as the balance; (a2) making a coarsely pulverized powder of the alloy; (a3) making a finely pulverized powder out of the coarsely pulverized powder of the alloy; and (a4) adding the lubricant to the powder between the steps (a2) and (a3) or after the step (a3).

In still another preferred embodiment, the aliphatic silver carboxylate or the aromatic silver carboxylate has 6 to 20 carbon atoms.

In yet another preferred embodiment, the inevitably contained impurities include Al, of which the content is 0.4 at % or less.

Thanks to the action of the very small amount of additive Ag, Ni or Au, a rare-earth sintered magnet according to the present invention can have as high coercivity as, and higher remanence than, a conventional R—Fe—B based sintered magnet including an additive Cu or Al.

DETAILED DESCRIPTION OF PREFERRED EMBODIMENTS

Figure 1:
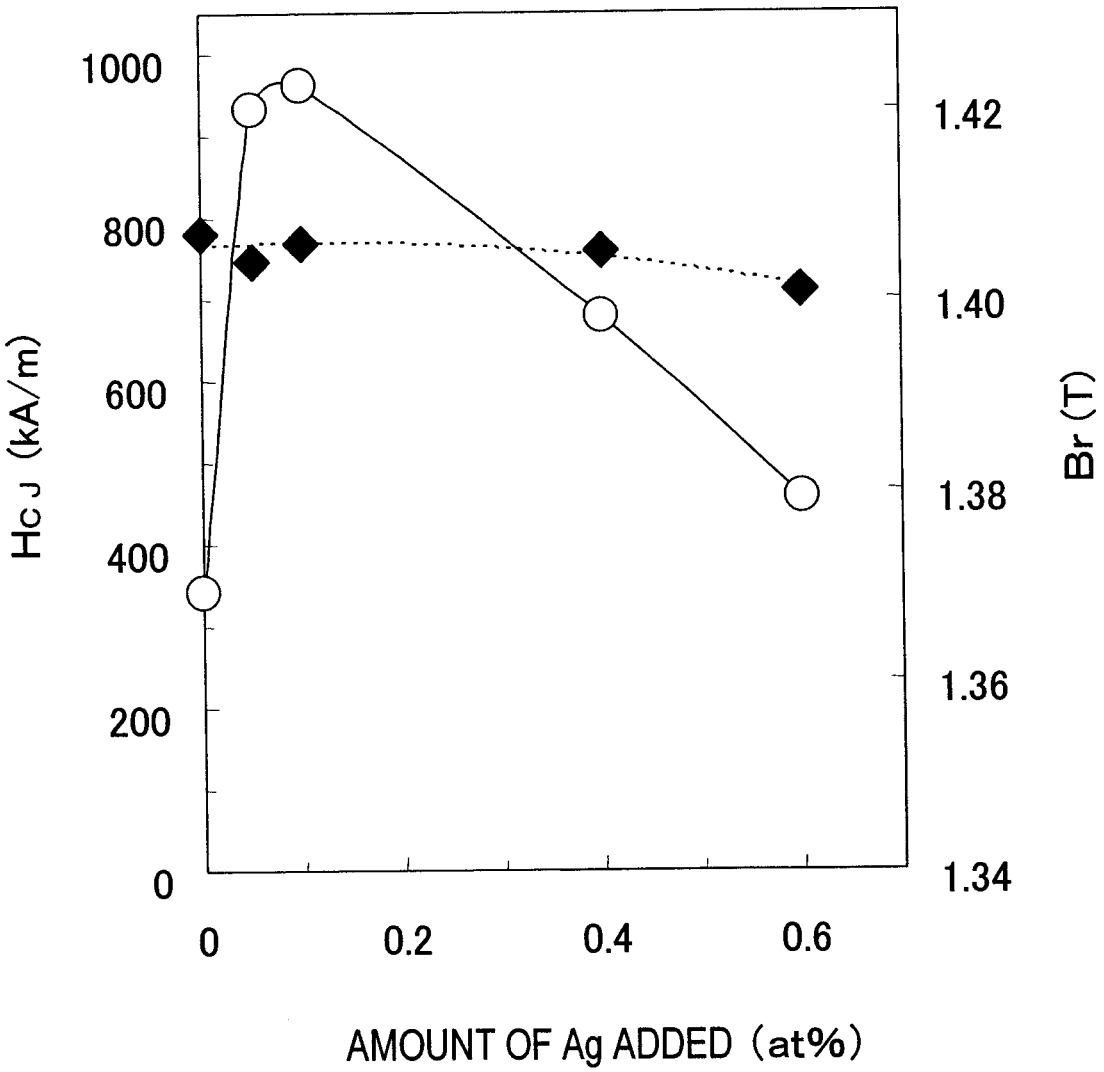
FIG. 1 is a graph showing how the magnet performance changes with the amount of Ag added, where the ordinate on the left-hand side represents the coercivity $H_{cJ}$ (kA/m) as plotted with ○ and the ordinate on the right-hand side represents the remanence $B_r$ (T) as plotted with ◆.

In the prior art, people attempted adding various elements in order to increase the coercivity. However, R-T-B based sintered magnets, which are the object of comparison, naturally contained Al and Cu as inevitably contained impurities. This is because if none of these elements were included, the resultant coercivity would be too low.

Nevertheless, the present inventors dared to adopt a simple ternary composition, to which no Al or Cu was added, for an Nd—Fe—B based sintered magnet and tried adding various elements in very small amounts. As a result, the present inventors discovered that when a very small amount of Ag, Ni or Au was added, the effects of increasing the coercivity significantly without decreasing the remanence showed up, thus acquiring the basic idea of the present invention. We also discovered that a beneficial effect was achieved as a further increase in coercivity by adding not only these very small amounts of elements but also at least one element selected from the group consisting of Ti, V, Cr, Zr, Nb, Mo, Hf, Ta and W.

It is not that nobody attempted adding Ag to R-T-B based sintered magnets in the prior art. For example, Patent Documents Nos. 2, 3 and 4 disclose that Ag is added to R-T-B based sintered magnets although its purpose is different. Also, Patent Documents Nos. 7, 8 and 9 disclose that Ni is added to R-T-B based sintered magnets. And Patent Documents Nos. 10 and 11 disclose that Au is added to R-T-B based sintered magnets.

However, Al and Cu had naturally been added to the R-T-B based sintered magnets, to which those elements should be added, either intentionally or as inevitable impurities. Therefore, the effect of increasing the coercivity to be achieved by adding a very small amount of Ag, Ni or Au was overwhelmed by the effect of increasing the coercivity to be achieved by adding Al, Cu or Dy and was quite unnoticeable. On top of that, the effects caused by adding very small amounts of those elements, which the present inventors discovered for the first time, cannot be achieved unless the amounts of the additives are very small and fall within very narrow ranges as will be described in detail later. Thus, those effects would not be achievable appropriately if the elements were added in the amounts taught in Patent Documents Nos. 2, 3 and 4.

As can be seen, the present invention was made based on those new findings that could not have been made unless the R-T-B based sintered magnet with the basic composition had been used as a comparative example and unless a very small amount of Ag, Ni or Au had been added. For the sake of simplicity, the element Ag, Ni or Au to be added in a very small amount according to the present invention will be referred to herein as an "additive metal A".

According to the results of experiments the present inventors carried out, the additive metal A would be present on the grain boundary phase of a sintered magnet. It is known that the grain boundary phase of an R-T-B based sintered magnet plays a key role in determining the magnitude of its coercivity. Thus, it is presumed that the very small amount of additive metal A would take some action to increase the coercivity on the grain boundary phase. However, it is not quite clear at this time exactly how and why the coercivity is increased by that very small amount of additive, although the present inventors are making every effort to figure out its mechanism.

In a preferred embodiment, Ag may be mixed in the form of a lubricant with the alloy powder without being added to the material alloy itself. By adding a lubricant including either an aliphatic silver carboxylate or an aromatic silver carboxylate, Ag, included in the silver salt of the lubricant, diffuses into the particles of the alloy powder during the sintering process, thus improving the properties of the resultant sintered magnet.

Hereinafter, preferred embodiments of a rare-earth sintered magnet according to the present invention will be described.

EMBODIMENTS

Material Alloy

First, a material alloy, including 12.0 at % to 15.0 at % of rare-earth element R, 5.5 at % to 8.5 at % of B, a predetermined percentage of additive metal A and Fe and inevitably contained impurities as the balance, is provided. R is at least one element selected from the group consisting of Nd, Pr, Gd, Tb, Dy and Ho and at least 50% of R is Nd and/or Pr. The predetermined percentage of additive metal A includes at least one of 0.005 at % to 0.30 at % of Ag, 0.005 at % to 0.40 at % of Ni, and 0.005 at % to 0.20 at % of Au. Optionally, 0.05 at % to 1.0 at % of element M, which is at least one element selected from the group consisting of Ti, V, Cr. Zr, Nb, Mo, Hf. Ta and W, may be further added.

If the mole fractions of R and B were out of these ranges, then the R-T-B based sintered magnet would lose its basic structure and desired magnet performance could not be realized. According to the present invention, by adding the additive metal A in a very small amount, the coercivity can be more than doubled, and yet the remanence hardly decreases, as compared to an R—Fe—B based rare-earth magnet with a basic ternary composition. If the mole fraction of the additive metal A were less than 0.005 at %, the coercivity could not be increased significantly. Conversely, if the mole fraction of the additive metal A exceeded the upper limit of the predetermined range, then the coercivity would rather drop. According to the results of experiments the present inventors carried out, the Ag mole fraction is preferably set within the range of 0.005 at % to 0.30 at %, more preferably from 0.005 at % to 0.20 at %. The Ni mole fraction is preferably set within the range of 0.005 at % to 0.40 at %, more preferably from 0.005 at % to 0.20 at %. And the Au mole fraction is preferably set within the range of 0.005 at % to 0.20 at %, more preferably from 0.005 at % to 0.10 at %.

It should be noted that if the mole fraction of the element M exceeded 1.0 at %, the coercivity would increase but the remanence would decrease significantly. That is why when the element M is added, the mole fraction of the element M is preferably set within the range of 0.05 at % to 1.0 at %, more preferably from 0.1 at % to 0.5 at %.

The additive metal A and element M may be added at any time as long as it is before the sintering process. That is to say, these elements may be added while the material alloy is being melted. Alternatively, a mother alloy including no additive metal A or element M may be provided and then the elements A and M may be added either to the alloy yet to be pulverized by a jet mill or to the pulverized alloy as fine powders. As another alternative, a mother alloy to which only the additive metal A has been added may be provided, pulverized by a jet mill, and then a fine powder of the element M may be added to the pulverized powder. Still alternatively, a mother alloy to which only the element M has been added may be provided, pulverized by a jet mill, and then a fine powder of the additive metal A may be added to the pulverized powder. That is to say, there is no need to add the additive metal A and the element M at the same time.

The fine powder of the additive metal A may be prepared by pulverizing either Ag metal, Ni metal or Au metal or a compound thereof such as a metal oxide. The powder or compound of the additive metal A may have a mean particle size of 0.5 μm to 50 μm, for example. This is because if the powder or compound falls within such a particle size range, a proper sintered body can still be obtained even when the powder or compound is mixed with any other alloy powder. The same can be said about the powder of the element M, as well as the powder of the additive metal A. The powder or compound of the element M may have a mean particle size of 0.5 μm to 50 μm, for example.

It should be noted that the sintered magnet of the present invention could include Al and/or Cu as inevitably contained impurities. However, the greater the content of Al, the lower the remanence. For that reason, the content of Al is preferably adjusted to 0.4 at % or less.

To make a mother alloy for use to make a sintered magnet according to the present invention, an ingot casting process or a rapid cooling process (such as a strip casting process or a centrifugal casting process) may be adopted. Hereinafter, a method of making a material alloy by a strip casting process will be described as an example.

First, a molten alloy is prepared by melting an alloy having the composition described above within an argon atmosphere by an induction melting process. Next, this molten alloy is maintained at 1,350° C. and then rapidly cooled by a single roller method, thereby obtaining alloy flakes with a thickness of about 0.3 mm, for example. The rapid solidification process may be performed at a roller peripheral velocity of about 1 m/s, a cooling rate of 500° C./s and a supercooling temperature of 200° C. The rapidly solidified alloy block obtained in this manner is pulverized into flakes with sizes of 1 mm to 10 mm before subjected to the next hydrogen pulverization process. Such a method of making a material alloy by a strip casting process is disclosed in U.S. Pat. No. 5,383,978, for example.

The additive metal A or element M may either have already been added to such a material alloy or be added during the pulverization process to be described below.

Coarse Pulverization Process

Next, the material alloy block that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This prevents oxidation or heat generation of the coarsely pulverized powder and improves the magnetic properties of the resultant magnet.

As a result of this hydrogen pulverization process, the rare-earth alloy is pulverized to sizes of about 0.1 mm to several millimeters with a mean particle size of 500 μm or less. After the hydrogen pulverization, the decrepitated material alloy is preferably further crushed to finer sizes and cooled with a cooling system such as a rotary cooler. If the material alloy unloaded still has a relatively high temperature, then the alloy should be cooled for a longer time using the rotary cooler or other suitable device.

Lubricant Adding Process

If the additive metal A is silver (Ag), Ag may be added not by the method described above but by adding a lubricant including a predetermined amount of aliphatic silver carboxylate or aromatic silver carboxylate to the coarsely pulverized powder obtained by the hydrogen pulverization and mixing the powder and the lubricant together. By adjusting the amount of the aliphatic silver carboxylate or aromatic silver carboxylate such that the resultant sintered magnet will include 0.005 at % to 0.20 at % of Ag, the same effects as those achieved by adding Ag by a different method can also be achieved.

Examples of carboxylic acids to form the silver salts include straight chain saturated fatty acids such as caprylic acid, capric acid, lauric acid, and stearic acid and aromatic carboxylic acids such as benzoic acid and t-butyl benzoic acid. As for these silver carboxylates, one of them may be used by itself or two or more of them may be used in combination. Alternatively, another lubricant including no silver may be added thereto. The point is that the amount of Ag included in the resultant sintered magnet falls within the predetermined range described above. For that purpose, zinc stearate may be added to the coarsely pulverized powder and then a lubricant including silver stearate may be added to its finely pulverized powder. It should be noted that an aliphatic silver carboxylate or aromatic silver carboxylate with less than six carbons might not fully achieve the effects expected by the addition of the lubricant. On the other hand, if the number of carbons exceeded twenty, that increase in the content of carbon might cause an insufficient sintered density or deteriorated magnet performance. To minimize such deterioration in magnet performance due to the excessive carbon, the amount of the lubricant added or left is preferably adjusted such that the carbon concentration of the resultant sintered magnet may not be more than 2,000 ppm.

According to the present invention, the resultant sintered magnet needs to have an Ag mole fraction that falls within the range of 0.005 at % to 0.20 at %. However, the amount of the lubricant to be added for that purpose changes with exactly when the lubricant is added. If silver stearate is added before the fine pulverization process to be described later, about 0.03 wt % to about 1.23 wt % of silver stearate may be added to the alloy powder. The amount of the lubricant added may be adjusted appropriately such that the resultant sintered magnet has an Ag mole fraction that falls within the range of 0.005 at % to 0.20 at % when the amount of Ag is measured.

The lubricant described above is solid at room temperature, and therefore, needs to be mixed as powder. The particle size of the lubricant may be controlled to the range of 1 μm to 50 μm, for example.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and gets the powder further pulverized by its pulverizer. The powder, which has been pulverized by the pulverizer, is then collected in a collecting tank by way of the cyclone classifier. In this manner, a finely pulverized powder with sizes of about 0.1 μm to about 20 μm can be obtained. The pulverizing machine for use in such a fine pulverization process does not have to be a jet mill but may also be an attritor or a ball mill.

Press Compaction Process

In this preferred embodiment, 0.3 wt % of lubricant is added to, and mixed with, the magnetic powder, obtained by the method described above, in a rocking mixer, thereby coating the surface of the alloy powder particles with the lubricant. Next, the magnetic powder prepared by the method described above is compacted under an aligning magnetic field using a known press machine. The aligning magnetic field to be applied may have a strength of 1 tesla (T), for example.

If Ag is added, a lubricant including the silver carboxylate described above may be further added after the fine pulverization process. Alternatively, the lubricant described above may be added only after the fine pulverization process without adding any lubricant at all before the fine pulverization process. As another alternative, only a known lubricant may be added before the fine pulverization process and then a lubricant including an aliphatic silver carboxylate or an aromatic silver carboxylate may be added after the fine pulverization process.

Sintering Process

The powder compact described above is preferably sequentially subjected to the process of maintaining the compact at a temperature of 650° C. to 1,000° C. for 10 to 240 minutes and then to the process of further sintering the compact at a higher temperature (of 1,000° C. to 1,100° C., for example) than in the maintaining process. Particularly when a liquid phase is produced during the sintering process (i.e., when the temperature is in the range of 650° C. to 1,000° C.), the R-rich phase on the grain boundary starts to melt to produce the liquid phase. Thereafter, the sintering process advances to form a sintered magnet eventually. The sintered magnet may be subjected to an aging treatment if necessary.

Optionally, before subjected to this sintering process, the powder compact may be subjected to a binder removal process of maintaining the powder compact at a temperature of 200° C. to 500° C. for about 30 minutes to about 300 minutes within a hydrogen atmosphere (which will be referred to herein as an "in-hydrogen binder removal process"). By performing such a process, carbon in the lubricant reacts to hydrogen and the lubricant is removed as hydrocarbon. As a result, the amount of the carbon that was included in the lubricant and is still left in the sintered magnet can be reduced. If such an in-hydrogen binder removal process is carried out, a greater amount of lubricant can be added.

Hereinafter, specific examples of the present invention will be described.

Example 1

An alloy consisting essentially of 14.1 at % of Nd, 6.1 at % of B, 0.05 at % to 0.6 at % of Ag, 0.05 at % of Al and Fe as the balance was provided and a sintered magnet was produced as Example #1 by the manufacturing process that has already been described by way of preferred embodiments. Meanwhile, Comparative Example #1 was also made of a mother alloy, having the same composition as Example #1 except that no Ag was added thereto, by the same method as that adopted for Example #1.

Before being pressed and compacted, the powder had a mean particle size of 4.4 μm. The compaction process was carried out under a magnetic field of 1.0 T. The resultant compact was subjected to a sintering process at a temperature of 1,000° C. to 1,100° C. for four hours and then to an aging treatment at a temperature of 620° C. for two hours. The sintered body thus obtained had a rectangular parallelepiped shape with dimensions of 11 mm×10 mm×18 mm.

FIG. 1 is a graph showing how the magnet performance changes with the amount of Ag added, where the ordinate on the left-hand side represents the coercivity $H_{cJ}$ (kA/m) as plotted with ○ and the ordinate on the right-hand side represents the remanence $B_r$ (T) as plotted with ◆.

As can be seen from FIG. 1, just by adding only 0.05 at % of Ag, the coercivity $H_{cJ}$ can be more than doubled from about 340 kA/m of the comparative example (to which no Ag is added) to about 930 kA/m. In the example shown in FIG. 1, the coercivity $H_{cJ}$ reaches its peak value when about 0.1 at % of Ag is added. However, once the amount of Ag added exceeds 0.3 at %, almost no effects are achieved even by adding Ag. On the other hand, if the amount of Ag added is 0.3 at % or less, the remanence $B_r$ hardly changes. But once the amount of Ag added exceeds, the remanence $B_r$ decreases gradually.

According to the results of more detailed experiments, it was discovered that the effects to be achieved by adding Ag manifested themselves when the amount of Ag added was at least equal to 0.005 at %. That is why the amount of Ag added is set within the range of 0.005 at % to 0.3 at % according to the present invention.

Example 2

An alloy consisting essentially of 14.1 at % of Nd, 6.1 at % of B and Fe as the balance was provided and sintered magnets made of the alloy were produced as Example #2 and Comparative Example #2 by the manufacturing process that has already been described by way of preferred embodiments. In Example #2, 0.02 at % to 0.5 at % of Ag powder was added to the alloy powder yet to be pressed and compacted. In Comparative Example #2, on the other hand, no Ag powder was added at all. Ag was mixed with the alloy powder either as Ag metal powder or as $Ag_2O$ powder.

Before being pressed and compacted, the powder had a mean particle size of 4.6 μm. The compaction process was carried out under a magnetic field of 1.0 T. The resultant compact was subjected to a sintering process at a temperature of 1,000° C. to 1,100° C. for four hours and then to an aging treatment at a temperature of 620° C. for two hours. The sintered body thus obtained had a rectangular parallelepiped shape with dimensions of 11 mm×10 mm×18 mm.

Figure 2:
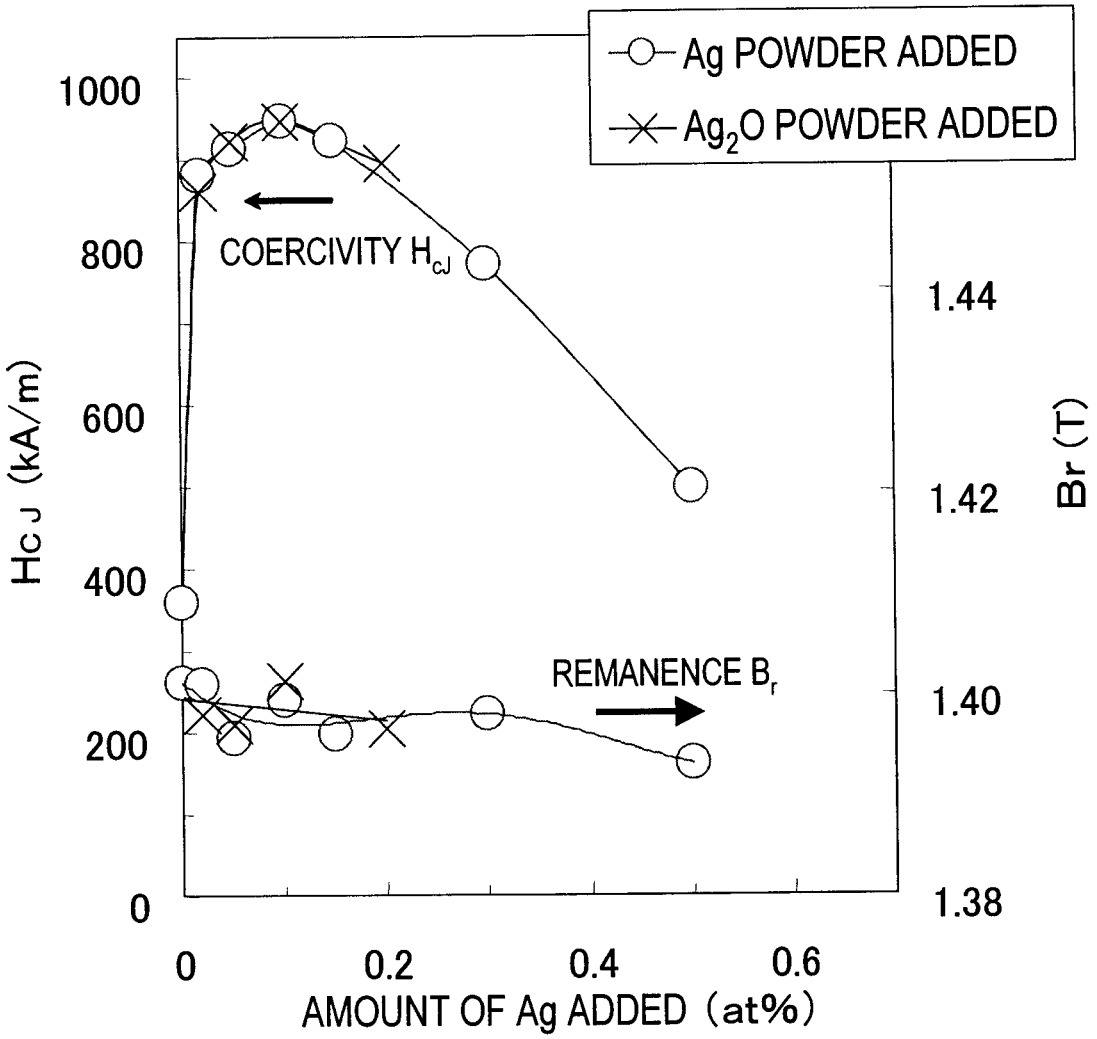
FIG. 2 is a graph showing how the coercivity $H_{cJ}$ changes with the amount of Ag added, where ○ indicates the results obtained by adding Ag metal powder and x indicates the results obtained by adding $Ag_2O$ powder.

FIG. 2 is a graph showing how the coercivity $H_{cJ}$ changes with the amount of Ag added, where ○ indicates the results obtained by adding Ag metal powder and x indicates the results obtained by adding $Ag_2O$ powder.

Comparing the results shown in FIGS. 1 and 2 with each other, it can be seen that the same effects are achieved by adding a very small amount of Ag no matter when it is added. That is to say, Ag may be added either to the alloy yet to be pulverized or to the pulverized powder. Also, can be seen easily from FIG. 2, Ag may be added either in the form of an Ag compound such as an Ag oxide or in the form of Ag metal.

Example 3

An alloy consisting essentially of 14.1 at % of Nd, 6.1 at % of B, 0.1 at % of Ag, 0.05 at % to 0.5 at % of Al, and Fe as the balance was provided and sintered magnets made of the alloy were produced as Example #3 and Comparative Example #3 by the manufacturing process that has already been described by way of preferred embodiments.

Before being pressed and compacted, the powder had a mean particle size of 4.6 μm. The compaction process was carried out under a magnetic field of 1.0 T. The resultant compact was subjected to a sintering process at a temperature of 1,000° C. to 1,060° C. for four hours and then to an aging treatment at a temperature of 600° C. to 640° C. for two hours. The sintered body thus obtained had a rectangular parallelepiped shape with dimensions of 11 mm×10 mm×18 mm.

Figure 3:
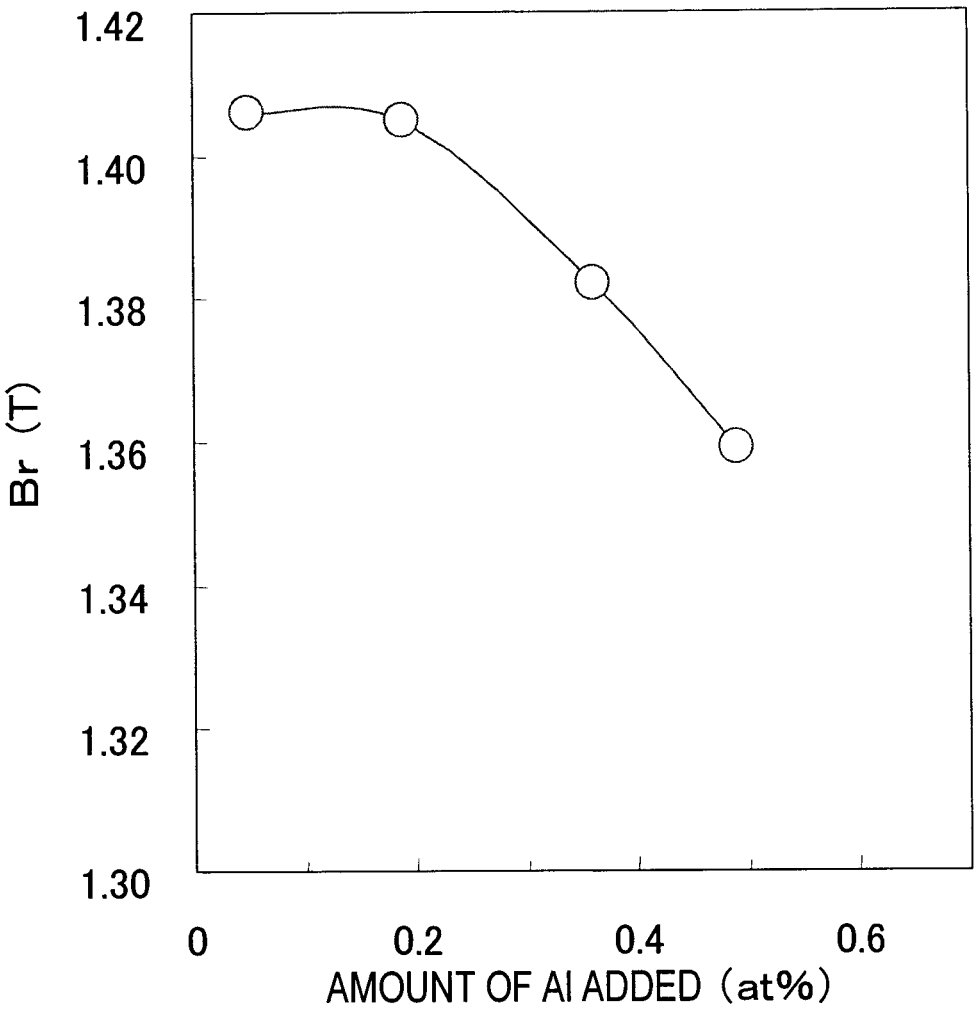
FIG. 3 is a graph showing how the remanence $B_r$ changes with the amount of Al added.

FIG. 3 is a graph showing how the remanence $B_r$ changes with the amount of Al added. It can be seen that if the amount of Al added exceeded 0.40 at %, the saturation magnetization would decrease too much to achieve the effects expected when a very small amount of Ag is added.

Example 4

An alloy consisting essentially of 11.4 at % of Nd, 2.8 at % of Pr, 6.1 at % of B, 0.1 at % of Ag, and Fe as the balance was provided and a sintered magnet made of the alloy was produced as Example #4 by the same manufacturing process as that adopted in Example #1. The magnetic properties of Example #4 included a coercivity $H_{cJ}$ of 1,035 kA/m and a remanence $B_r$ of 1.39 T. Thus, it was confirmed that the present invention was effective enough even if another rare-earth element such as Pr was further added as well as Nd.

Example 5

An alloy consisting essentially of 14.1 at % of Nd, 6.1 at % of B, 0.005 at % to 0.30 at % of Ag, 0.4 at % of Mo, and Fe as the balance was provided and a sintered magnet made of the alloy was produced as Example #5 by the manufacturing process that has already been described by way of preferred embodiments. Meanwhile, Comparative Example #4 was also made of a mother alloy, having the same composition as Example #5 except that no Ag or no element M was added thereto, by the same method as that adopted for Example #5.

Before being pressed and compacted, the powder had a mean particle size of 4.4 μm. The compaction process was carried out under a magnetic field of 1.0 T. The resultant compact was subjected to a sintering process at a temperature of 1,000° C. to 1,100° C. for four hours and then to an aging treatment at a temperature of 620° C. for two hours. The sintered body thus obtained had a rectangular parallelepiped shape with dimensions of 11 mm×10 mm×18 mm.

Figure 4:
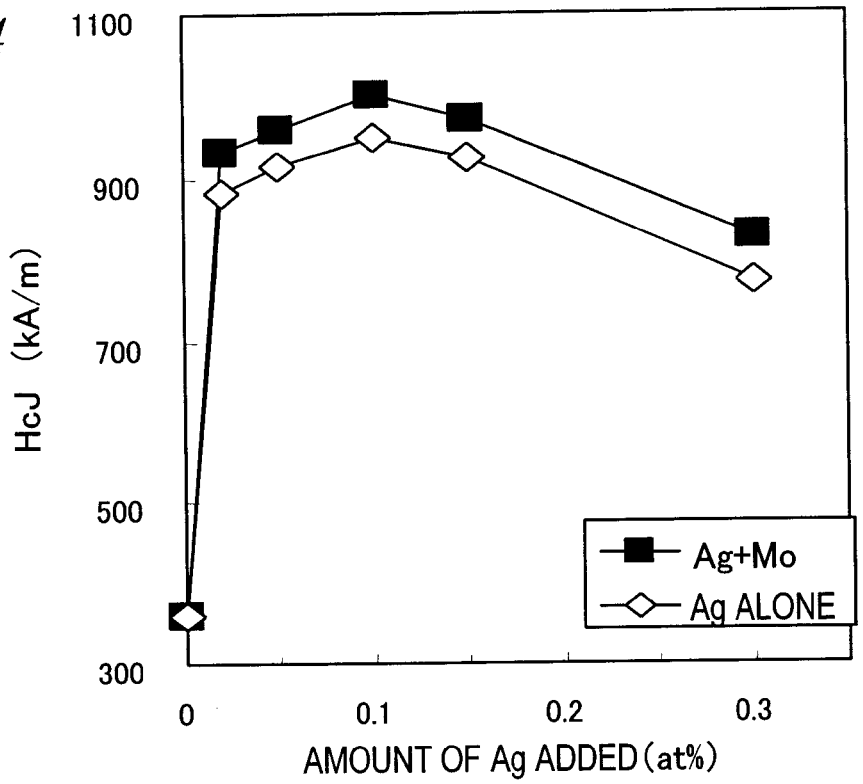
FIG. 4 is a graph showing how the coercivity $H_{cJ}$ changes with the amount of Ag added.

FIG. 4 is a graph showing how the coercivity $H_{cJ}$ (kA/m) changes with the amount of Ag added, where data about the example to which 0.4 at % of Mo was added is plotted with ■ and data about the comparative example to which no Mo was added is plotted with □.

As can be seen from FIG. 4, just by adding only 0.05 at % of Ag, the coercivity $H_{cJ}$ can be more than doubled from about 340 kA/m (when no Ag was added) to about 930 kA/m in both the example and the comparative example. In the example shown in FIG. 4, the coercivity $H_{cJ}$ reaches its peak value when about 0.1 at % of Ag is added. However, once the amount of Ag added exceeds 0.3 at %, almost no effects are achieved even by adding Ag.

As also can be seen from FIG. 4, the coercivity can be further increased by adding not just Ag but also 0.4 at % of Mo.

According to the results of more detailed experiments, it was discovered that the increase in coercivity achieved by adding a very small amount of Ag was further promoted by adding not only Mo but also at least one element selected from the group consisting of Ti, V, Nb and W. It was also confirmed that the effects achieved by adding those element M showed up when the mole fraction of Ag was in the range of 0.005 at % to 0.30 at %.

Example 6

An alloy consisting essentially of 14.1 at % of Nd, 6.1 at % of B, 0.1 at % of Ag, 0.05 at % to 1.0 at % of element M (which is at least one element selected from the group consisting of Ti, V, Nb Mo and W), and Fe as the balance was provided and a sintered magnet made of the alloy was produced as Example #6 by the manufacturing process that has already been described by way of preferred embodiments. Meanwhile, Comparative Example #5 was also made of a mother alloy, having the same composition as Example #6 except that no element M was added thereto, by the same method as that adopted for Example #6.

Before being pressed and compacted, the powder had a mean particle size of 4.4 μm. The compaction process was carried out under a magnetic field of 1.0 T. The resultant compact was subjected to a sintering process at a temperature of 1,000° C. to 1,100° C. for four hours and then to an aging treatment at a temperature of 620° C. for two hours. The sintered body thus obtained had a rectangular parallelepiped shape with dimensions of 11 mm×10 mm×18 mm.

Figure 5:
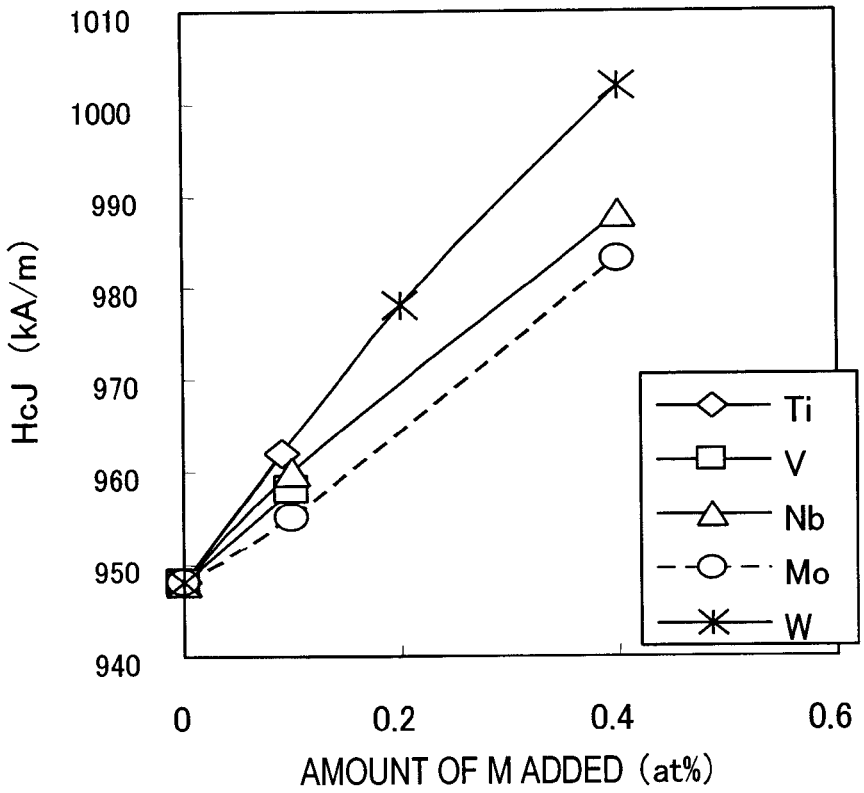
FIG. 5 is a graph showing how the coercivity $H_{cJ}$ changes with the amount of element M added.

FIG. 5 is a graph showing how the coercivity $H_{cJ}$ (kA/m) changes with the amount of element M added. In FIG. 5, the ordinate represents the coercivity $H_{cJ}$ (kA/m).

As can be seen from FIG. 5, just by adding only about 0.1 at % of Ti, V, Nb, Mo or W, the coercivity $H_{cJ}$ can be increased from about 950 kA/m of Comparative Example #5 in which 0.1 at % of Ag was added. In the example shown in FIG. 5, as the amount of element M added increases, the coercivity $H_{cJ}$ also increases.

According to the results of more detailed experiments, it was discovered that the effects to be achieved by adding element M manifested themselves when the amount of element M added was in the range of 0.05 at % to 1.0 at %.

As far as remanence is concerned, the rare-earth magnets of Examples #5 and #6 of the present invention were comparable to a conventional R—Fe—B based rare-earth magnet to which Cu or Al was added.

The present inventors also confirmed that the same effects were achieved not only by the elements M added in the examples described above but also by using Cr, Zr, Hf or Ta as an alternative element M.

Example 7

An alloy consisting essentially of 14.1 at % of Nd, 6.1 at % of B, 0.05 at % of Al, and Fe as the balance was provided and a sintered magnet made of the alloy was produced as Example #7 by the manufacturing process that has already been described by way of preferred embodiments. 0.12 wt % to 0.3 wt % of silver stearate was added as lubricant to Example #7. On the other hand, not silver stearate but zinc stearate was added to Comparative Example #6.

Before being pressed and compacted, the powder had a mean particle size of 4.4±0.2 μm. The compaction process was carried out under a magnetic field of 1.7 T. The resultant compact was subjected to a sintering process at a temperature of 1,000° C. to 1,100° C. for four hours and then to an aging treatment at a temperature of 500° C. to 700° C. for two hours. The sintered body thus obtained had a rectangular parallelepiped shape with dimensions of 20 mm×50 mm×12 mm.

Figure 6:
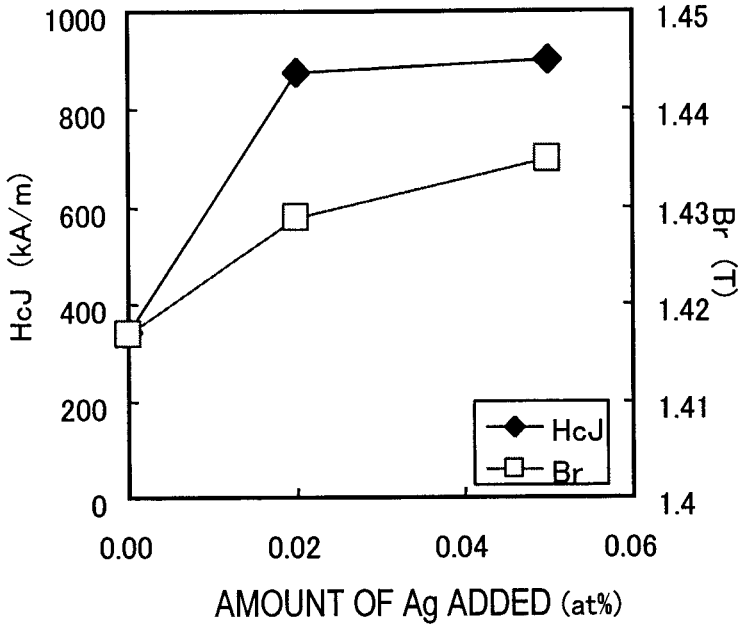
FIG. 6 is a graph showing how the magnet performance changes with the amount of Ag added, where the ordinate on the left-hand side represents the coercivity $H_{cJ}$ (kA/m) as plotted with ◆ and the ordinate on the right-hand side represents the remanence $B_r$ (T) as plotted with □.

FIG. 6 is a graph showing how the magnet performance changes with the amount of Ag added, where the ordinate on the left-hand side represents the coercivity $H_{cJ}$ (kA/m) as plotted with ♦ and the ordinate on the right-hand side represents the remanence $B_r$ (T) as plotted with □.

As can be seen from FIG. 6, just by adding only 0.02 at % of Ag, the coercivity $H_{cJ}$ can be more than doubled from about 340 kA/m of the comparative example (to which no Ag is added) to about 880 kA/m. Although not shown in FIG. 6, once the amount of Ag added exceeds 0.2 at %, the magnet performance deteriorates and almost no effects are achieved even by adding Ag.

According to the results of more detailed experiments, it was discovered that the effects to be achieved by adding Ag manifested themselves when the amount of Ag added was at least equal to 0.005 at %. That is why the amount of Ag added is set within the range of 0.005 at % to 0.2 at % according to the present invention. Also, according to the present invention, the amount of Ag added is controlled by adjusting the amount of the lubricant added. Therefore, if the amount of Ag added is increased, the content of carbon in the lubricant naturally increases. However, the higher the content of carbon, the more likely the performance of the sintered magnet deteriorates. For that reason, if the amount of the lubricant added is increased, the process step of vaporizing the lubricant sufficiently is preferably carried out before the sintering process. If the binder removal process described above is carried out, the lubricant may be added such that the amount of Ag added will be 0.2 at % eventually.

Example 8

An alloy consisting essentially of 14.1 at % of Nd, 6.1 at % of B, 0.02 at % to 0.5 at % of Al, and Fe as the balance was provided and a sintered magnet made of the alloy was produced as Example #7 by the manufacturing process that has already been described by way of preferred embodiments. 0.12 wt % of silver stearate was added as a lubricant to Example #8 before a fine pulverization process using a jet mill. The amount of Ag added became 0.02 at % of the entire sintered magnet in the end.

Before being pressed and compacted, the powder had a mean particle size of 4.4±0.2 μm. The compaction process was carried out under a magnetic field of 1.7 T. The resultant compact was subjected to a sintering process at a temperature of 1,000° C. to 1,100° C. for four hours and then to an aging treatment at a temperature of 500° C. to 650° C. for two hours. The sintered body thus obtained had a rectangular parallelepiped shape with dimensions of 20 mm×50 mm×12 mm.

Figure 7:
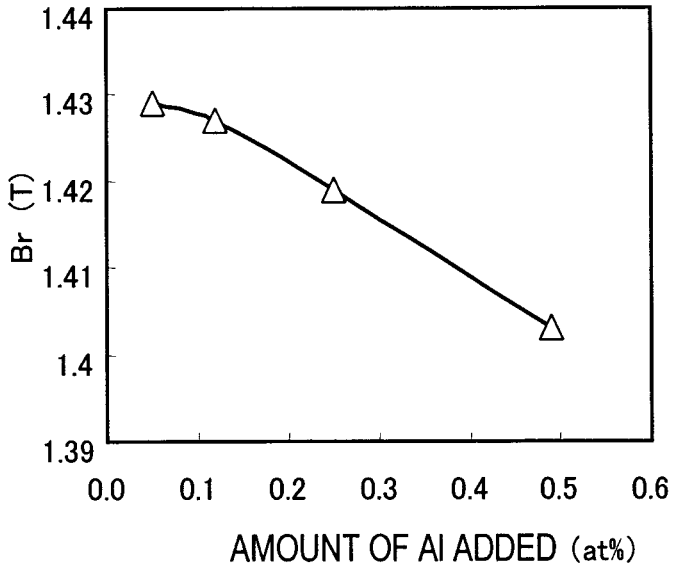
FIG. 7 is a graph showing how the remanence $B_r$ changes with the amount of Al added.

FIG. 7 is a graph showing how the remanence $B_r$ changes with the amount of Al added. It can be seen that once the amount of Al added exceeds 0.40 at %, the remanence $B_r$ decreases, thus possibly ruining the effects caused by adding a very small amount of Ag.

Example 9

An alloy consisting essentially of 14.1 at % of Nd, 6.1 at % of B, 0.05 at % to 0.6 at % of Ni, 0.05 at % of Al and Fe as the balance was provided and a sintered magnet was produced as Example #9 by the manufacturing process that has already been described by way of preferred embodiments. Meanwhile, Comparative Example #7 was also made of a mother alloy, having the same composition as Example #9 except that no Ni was added thereto, by the same method as that adopted for Example #9.

Before being pressed and compacted, the powder had a mean particle size of 4.4 μm to 4.6 μm. The compaction process was carried out under a magnetic field of 1.0 T. The resultant compact was subjected to a sintering process at a temperature of 1,000° C. to 1,100° C. for four hours and then to an aging treatment at a temperature of 580° C. to 660° C. for two hours. The sintered body thus obtained had a rectangular parallelepiped shape with dimensions of 11 mm×10 mm×18 mm.

Figure 8:
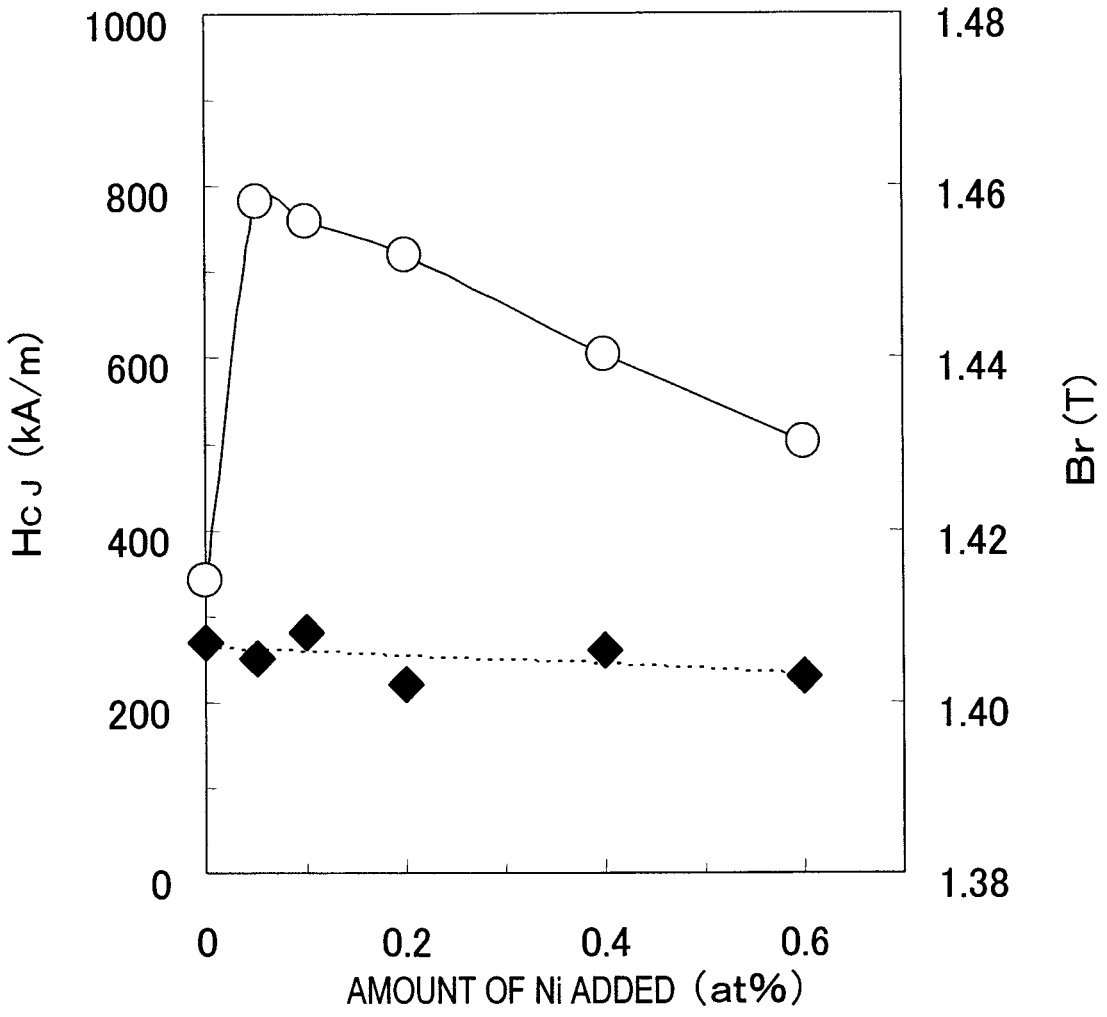
FIG. 8 is a graph showing how the magnet performance changes with the amount of Ni added, where the ordinate on the left-hand side represents the coercivity $H_{cJ}$ (kA/m) as plotted with ○ and the ordinate on the right-hand side represents the remanence $B_r$ (T) as plotted with ◆.

FIG. 8 is a graph showing how the magnet performance changes with the amount of Ni added, where the ordinate on the left-hand side represents the coercivity $H_{cJ}$ (kA/m) as plotted with ○ and the ordinate on the right-hand side represents the remanence $B_r$ (T) as plotted with ◆.

As can be seen from FIG. 8, just by adding only 0.05 at % of Ni, the coercivity $H_{cJ}$ can be more than doubled from about 340 kA/m of Comparative Example #7 (to which no Ni is added) to about 800 kA/m. In the example shown in FIG. 8, the coercivity $H_{cJ}$ reaches its peak value when about 0.05 at % of Ni is added. However, once the amount of Ni added exceeds 0.4 at %, the effect achieved by adding Ni wears off gradually. On the other hand, if the amount of Ni added is 0.4 at % or less, the remanence $B_r$ hardly changes.

According to the results of more detailed experiments, it was discovered that the effects to be achieved by adding Ni manifested themselves when the amount of Ni added was at least equal to 0.005 at %. That is why the amount of Ni added is set within the range of 0.005 at % to 0.4 at % according to the present invention.

Example 10

An alloy consisting essentially of 14.1 at % of Nd, 6.1 at % of B and Fe as the balance was provided and sintered magnets made of the alloy were produced as Example #10 and Comparative Example #8 by the manufacturing process that has already been described by way of preferred embodiments. In Example #10, 0.02 at % to 0.5 at % of Ni powder was added to the alloy powder yet to be pressed and compacted. In Comparative Example #8, on the other hand, no Ni powder was added at all. Ni was mixed with the alloy powder either as Ni metal powder or as NiO powder.

Before being pressed and compacted, the powder had a mean particle size of 4.6 μm. The press compaction process was carried out under a magnetic field of 1.0 T. The resultant compact was subjected to a sintering process at a temperature of 1,000° C. to 1,100° C. for four hours and then to an aging treatment at a temperature of 580° C. to 620° C. for two hours. The sintered body thus obtained had a rectangular parallelepiped shape with dimensions of 11 mm×10 mm×18 mm.

Figure 9:
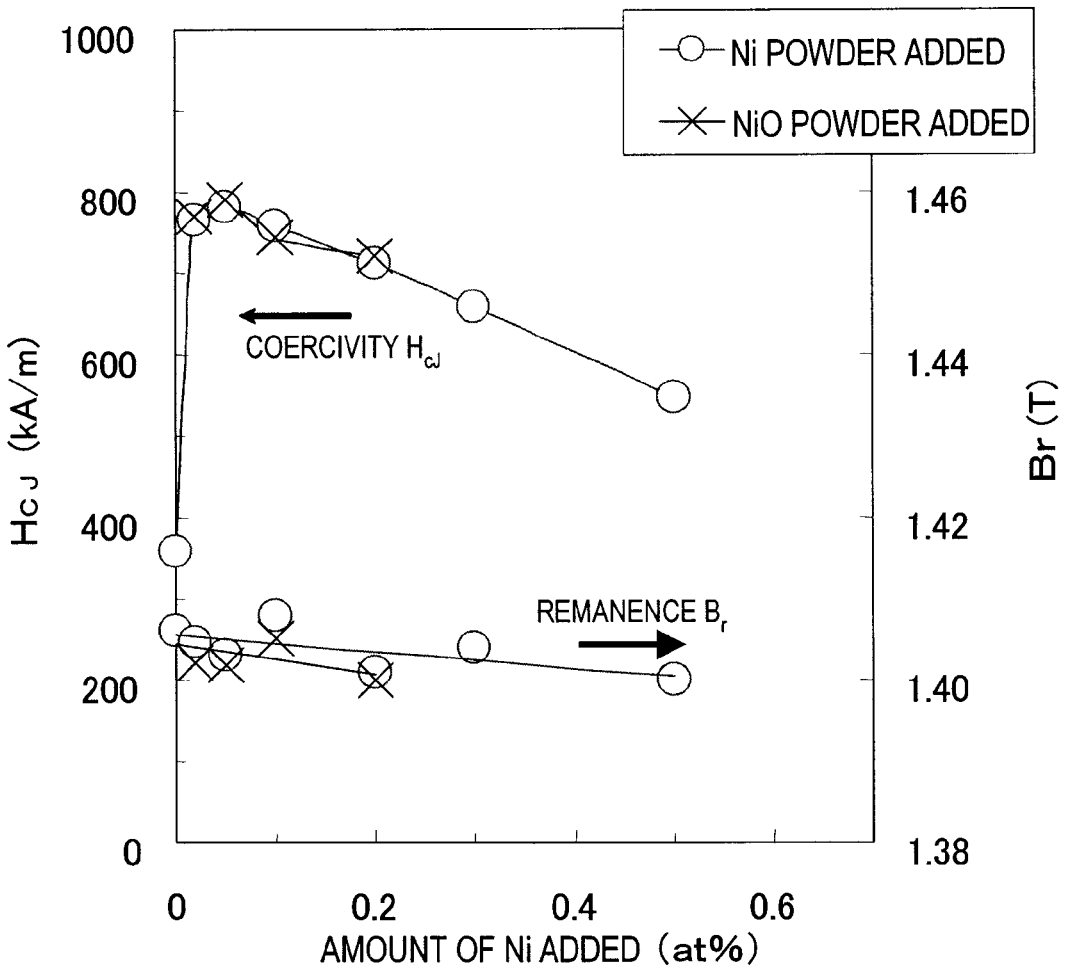
FIG. 9 is a graph showing how the coercivity $H_{cJ}$ changes with the amount of Ni added, where ○ indicates the results obtained by adding Ni metal powder and x indicates the results obtained by adding NiO powder.

FIG. 9 is a graph showing how the coercivity $H_{cJ}$ changes with the amount of Ni added, where ○ indicates the results obtained by adding Ni metal powder and x indicates the results obtained by adding NiO powder.

Comparing the results shown in FIGS. 8 and 9 with each other, it can be seen that the same effects are achieved by adding a very small amount of Ni, no matter when it is added. That is to say, Ni may be added either to the alloy yet to be pulverized or to the pulverized powder. Also, can be seen easily from FIG. 9, Ni may be added either in the form of an Ni compound such as an Ni oxide or in the form of Ni metal.

Example 11

An alloy consisting essentially of 14.1 at % of Nd, 6.1 at % of B, 0.05 at % of Ni, 0.05 at % to 0.5 at % of Al, and Fe as the balance was provided and sintered magnets made of the alloy were produced as Example #11 and Comparative Example #9 by the manufacturing process that has already been described by way of preferred embodiments.

Before being pressed and compacted, the powder had a mean particle size of 4.5 μm to 4.7 μm. The compaction process was carried out under a magnetic field of 1.0 T. The resultant compact was subjected to a sintering process at a temperature of 1,000° C. to 1,060° C. for four hours and then to an aging treatment at a temperature of 600° C. to 620° C. for two hours. The sintered body thus obtained had a rectangular parallelepiped shape with dimensions of 11 mm×10 mm×18 mm.

Figure 10:
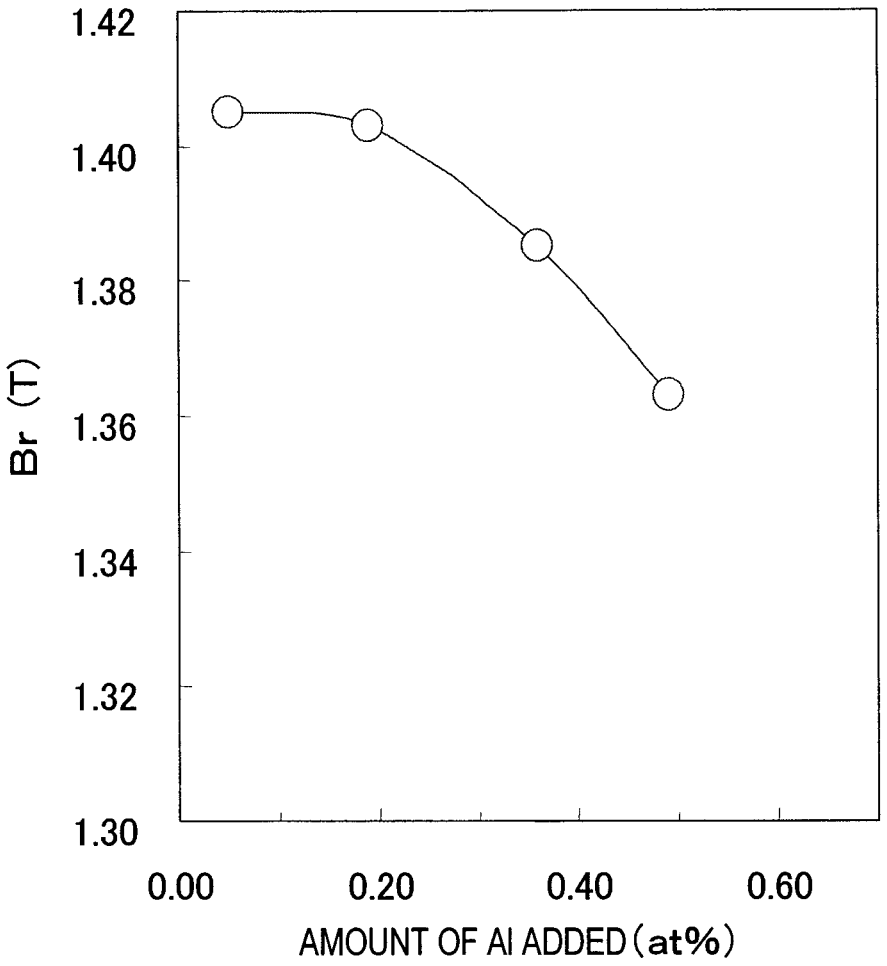
FIG. 10 is a graph showing how the remanence $B_r$ changes with the amount of Al added.

FIG. 10 is a graph showing how the remanence $B_r$ changes with the amount of Al added. It can be seen that if the amount of Al added exceeded 0.40 at %, the saturation magnetization would decrease too much to achieve the effects expected when a very small amount of Ni is added.

Example 12

An alloy consisting essentially of 11.4 at % of Nd, 2.8 at % of Pr, 6.1 at % of B, 0.05 at % of Ni, and Fe as the balance was provided and a sintered magnet made of the alloy was produced as Example #12 by the same manufacturing process as that adopted in Example #9. The magnetic properties of Example #12 included a coercivity $H_{cJ}$ of 855 kA/m and a remanence $B_r$ of 1.39 T. Thus, it was confirmed that the present invention was effective enough even if another rare-earth element such as Pr was further added as well as Nd.

Example 13

An alloy consisting essentially of 14.0 at % of Nd, 6.0 at % of B, 0.01 at % to 0.3 at % of Au, 0.05 at % of Al, and Fe as the balance was provided and a sintered magnet made of the alloy was produced as Example #13 by the manufacturing process that has already been described by way of preferred embodiments. Meanwhile, Comparative Example #10 was also made of a mother alloy, having the same composition as Example #13 except that no Au was added thereto, by the same method as that adopted for Example #13.

Before being pressed and compacted, the powder had a mean particle size of 4.4 μm to 4.6 μm. The compaction process was carried out under a magnetic field of 1.5 T. The resultant compact was subjected to a sintering process at a temperature of 1,000° C. to 1,100° C. for four hours and then to an aging treatment at a temperature of 500° C. to 700° C. for two hours. The sintered body thus obtained had a rectangular parallelepiped shape with dimensions of 20 mm×50 mm×15 mm.

Figure 11:
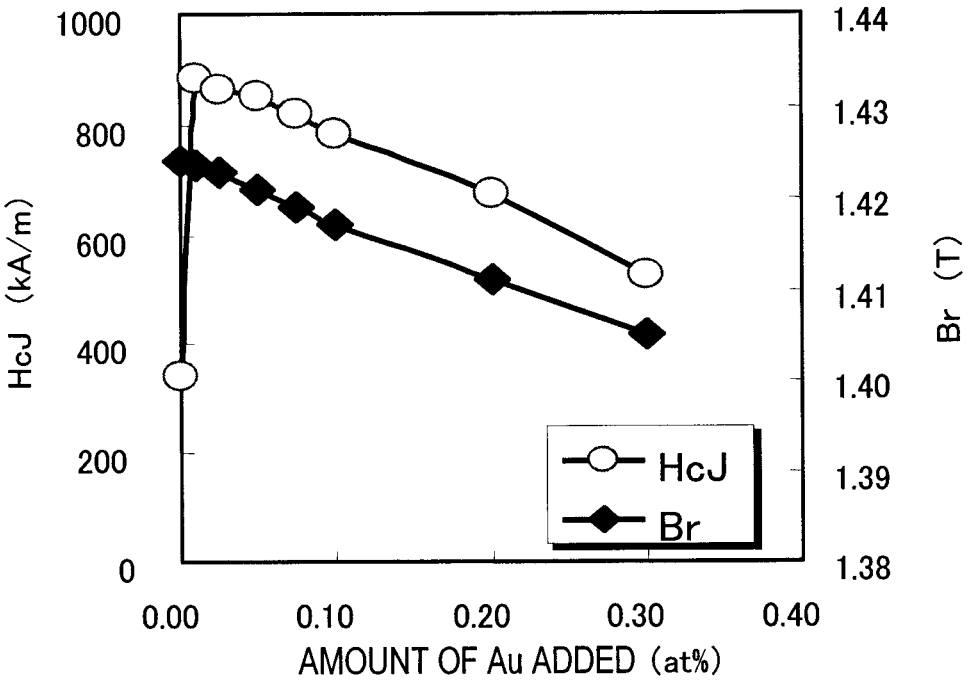
FIG. 11 is a graph showing how the magnet performance changes with the amount of Au added, where the ordinate on the left-hand side represents the coercivity $H_{cJ}$ (kA/m) as plotted with ○ and the ordinate on the right-hand side represents the remanence $B_r$ (T) as plotted with ◆.

FIG. 11 is a graph showing how the magnet performance changes with the amount of Au added, where the ordinate on the left-hand side represents the coercivity $H_{cJ}$ (kA/m) as plotted with ○ and the ordinate on the right-hand side represents the remanence $B_r$ (T) as plotted with ◆.

As can be seen from FIG. 11, just by adding only 0.01 at % of Au, the coercivity $H_{cJ}$ can be more than doubled from about 340 kA/m of Comparative Example #10 (to which no Au was added) to about 890 kA/m. In the example shown in FIG. 11, the coercivity $H_{cJ}$ reaches its peak value when about 0.01 at % of Au is added. However, once the amount of Au added exceeds 0.3 at %, almost no effects are achieved even by adding Au. On the other hand, as the amount of Au added increases, the remanence $B_r$ decreases gradually.

According to the results of more detailed experiments, it was discovered that the effects achieved by adding Au showed up when the mole fraction of Au was at least equal to 0.005 at %. That is why the amount of Au added is set within the range of 0.005 at % to 0.2 at % according to the present invention.

Example 14

An alloy consisting essentially of 14.0 at % of Nd, 6.0 at % of B, 0.05 at % of Au, 0.05 at % to 0.5 at % of Al, and Fe as the balance was provided and sintered magnets made of the alloy were produced as Example #14 and Comparative Example #11 by the manufacturing process that has already been described by way of preferred embodiments.

Before being pressed and compacted, the powder had a mean particle size of 4.4 μm to 4.6 μm. The compaction process was carried out under a magnetic field of 1.5 T. The resultant compact was subjected to a sintering process at a temperature of 1,000° C. to 1,060° C. for four hours and then to an aging treatment at a temperature of 550° C. to 650° C. for two hours. The sintered body thus obtained had a rectangular parallelepiped shape with dimensions of 20 mm×50 mm×15 mm.

Figure 12:
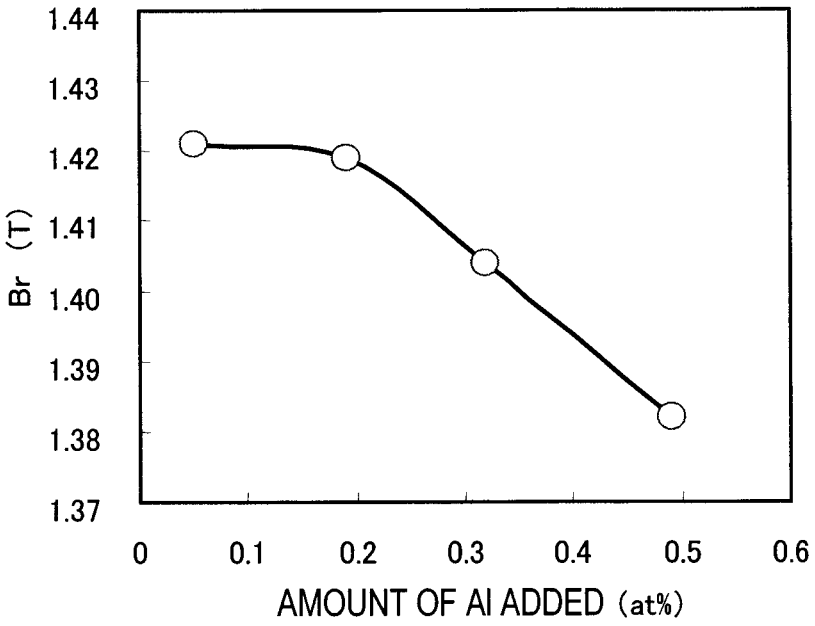
FIG. 12 is a graph showing how the remanence $B_r$ changes with the amount of Al added.

FIG. 12 is a graph showing how the remanence $B_r$ changes with the amount of Al added. It can be seen that once the amount of Al added exceeds 0.4 at %, the saturation magnetization becomes almost equal to that of a magnet with a conventional composition including additives Al and Cu, thus possibly ruining the effects caused by adding a very small amount of Au.

Example 15

An alloy consisting essentially of 11.2 at % of Nd, 2.8 at % of Pr, 6.0 at % of B, 0.05 at % of Au, and Fe as the balance was provided and a sintered magnet made of the alloy was produced as Example #15 by the same manufacturing process as that adopted in Example #14. The magnetic properties of Example #15 included a coercivity $H_{cJ}$ of 929 kA/m and a remanence $B_r$ of 1.41 T. Thus, it was confirmed that the present invention was effective enough even if another rare-earth element such as Pr was further added as well as Nd.

The results of the specific examples of the present invention described above revealed that more striking effects were achieved by the additive Ag than any other additive metal A. The effects increased in the order of Ni, Au and Ag.

A rare-earth sintered magnet according to the present invention realizes as high coercivity as, and higher remanence than, a conventional R—Fe—B based rare-earth sintered magnet to which Cu and/or Al are/is added. Therefore, the rare-earth sintered magnet of the present invention can be used effectively in various applications in which both coercivity and remanence should be high.

The invention claimed is:

1. A magnet comprising:

12.0 at % to 15.0 at % of rare-earth element(s), which is at least one element selected from the group consisting of Nd, Pr, Gd, Tb, Dy and Ho and at least 50% of which is Nd;

5.5 at % to 8.5 at % of boron (B);

a predetermined percentage of additive metal A; and iron (Fe) and inevitably contained impurities as the balance; wherein the predetermined percentage of additive metal A includes one of 0.005 at % to 0.10 at % of silver (Ag) and 0.005 at % to 0.10 at % of gold (Au); and the magnet is a rare-earth sintered magnet; wherein the inevitably contained impurities include Al, of which the content is 0.4 at % or less.

2. The magnet of claim 1, comprising 0.005 at % to 0.40 at % of Ni.

3. The magnet of claim 1, further comprising 0.05 at % to 1.0 at % of element M, which is at least one element selected from the group consisting of Ti, V, Cr, Zr, Nb, Mo, Hf, Ta and W.

* * * * *